US005274428A

United States Patent [19]

Wong et al.

[11] Patent Number: 5,274,428

[45] Date of Patent: Dec. 28, 1993

[54] SINGLE PASS DIRECT TRANSFER COLOR PRINTER

[75] Inventors: Lam F. Wong, Fairport; George J. Roller, Penfield; Venkatesh H. Kamath, Fairport, all of N.Y.

[73] Assignee: Xerox Corporation, Stamford, Conn.

[21] Appl. No.: 903,387

[22] Filed: Jun. 24, 1992

[51] Int. Cl.[5] ..... G03G 15/01

[52] U.S. Cl. ..... 355/326 R; 355/327; 346/157; 346/160.1; 430/42

[58] Field of Search ..... 355/326, 327, 310, 32, 355/312; 346/157, 160.1, 49; 430/42, 44; 271/194, 196, 197

[56] References Cited

U.S. PATENT DOCUMENTS

| | | | |
|---|---|---|---|
| 4,239,370 | 12/1980 | Kurita | 355/326 |
| 4,370,047 | 1/1983 | Damouth et al. | 355/327 |
| 4,371,253 | 2/1983 | Day et al. | 355/327 |
| 4,469,433 | 9/1984 | Kurata et al. | 355/327 |
| 4,531,828 | 7/1985 | Hoshino | 355/327 X |
| 4,540,992 | 9/1985 | Moteki et al. | 355/326 X |
| 4,733,270 | 3/1988 | Nishikawa et al. | 346/157 X |
| 4,734,788 | 3/1988 | Emmett et al. | 355/327 X |
| 4,803,515 | 2/1989 | Hoshino et al. | 355/327 X |
| 4,989,020 | 2/1990 | Namba | 346/157 |
| 4,990,969 | 2/1991 | Rapkin | 355/327 |
| 4,994,858 | 2/1991 | Lubberts | 355/327 X |
| 5,016,062 | 5/1991 | Rapkin | 355/327 |
| 5,031,002 | 7/1991 | Yaguchi | 355/312 |
| 5,043,761 | 8/1991 | Johnson | 355/326 |
| 5,150,161 | 9/1992 | Bujese | 355/256 |
| 5,158,846 | 10/1992 | Bujese | 355/327 |
| 5,177,542 | 1/1993 | Lubberts | 355/271 |
| 5,200,285 | 4/1993 | Carrish | 430/45 |
| 5,200,782 | 4/1993 | Castelli et al. | 355/271 X |

FOREIGN PATENT DOCUMENTS

| | | | |
|---|---|---|---|
| 0040372 | 3/1985 | Japan | 271/194 |

OTHER PUBLICATIONS

*Xerox Disclosure Journal*, vol. 7, No. 4, Jul./Aug. 1982, p. 265, Silverberg M., "Reduction of Required Drive Force on a Transverse Ground Vacuum Belt".

*Xerox Disclosure Journal*, vol. 4, No. 2, Mar./Apr. 1979, p. 215, Abreu, C. O., "Transport for Allowing Sheet Buckle".

*Primary Examiner*—Matthew S. Smith

*Attorney, Agent, or Firm*—Oliff & Berridge

[57] ABSTRACT

A high throughput, single pass direct transfer color printer utilizing a roll web based design which simplifies tandem engine architecture by eliminating a very difficult subsystem. Improved image registration is achieved simply by position/velocity synchronization of the paper web with respect to photoreceptors of the tandem print engines. Frictional slip between the web and an overrunning vacuum transport develops web tension which in turn provides a positive contact between the web and the photoreceptors needed for good image transfer. An arcuate convex paper path increases normal forces applied to the engines which increases contact pressure, as well as increasing contact surface area of the engines and the web. A web buckle between the vacuum transport and a fuser is provided to reduce vibrational disturbances and a cutter furnishes a print-out in an appropriate size.

15 Claims, 2 Drawing Sheets

SINGLE PASS DIRECT TRANSFER COLOR PRINTER

BACKGROUND OF THE INVENTION

1.Field of the Invention

The present invention relates to a high throughput, single pass direct transfer roll web based color printer utilizing a simplified tandem engine architecture.

2. Description of Related Art

Many designs of color printers and copiers have been proposed. One type of copier utilizes a single engine architecture, requiring the multi-pass transfer of three primary color images onto a copy paper. However, there is a severe drawback to the throughput limitations of single engine color copiers.

For higher productivity, multiple engines in tandem types of architectures have been proposed. One common approach utilizes an intermediate transfer belt to accumulate sequentially all of the primary images, then the composite image is transferred to copy paper in a single pass.

Another approach utilizes a paper escort mechanism to bring the paper in contact with the different color engines for image transfer to take place. Examples of this utilize a chain gripper or a large drum with a mesh screen.

U.S. Pat. No. 4,531,828 to Hoshino discloses a color copier having a tandem engine architecture. The color copier comprises four sets of laser beam printer mechanisms, an insulative screen belt formed of meshes of fibers and driven by a pair of belt driving rollers, a paper supply mechanism and a fixing device. This design utilizes a belt to engage and drive a paper through the copier to provide multicolor images thereon. This design has inherent problems with registration and attempts to remedy the problem by designing lengths between tandem engines of the copier to equal a circumference of a drive roll.

U.S. Pat. No. 5,016,062 to Rapkin discloses a multicolor copier which comprises a primary imaging member (a conductive endless web), four secondary imaging members, a charging station, an exposure station, a development station, transfer stations, and a cleaning station. The secondary imaging stations are in the form of drums and each include a fusing station, a charging station and a toning station.

U.S. Pat. No. 4,994,858 to Lubberts discloses a multicolor copier comprising an endless imaging web supported by a large diameter drum and at least one small diameter roller. First and second electrostatic images are created and toned on a same portion of the web as it is moved by the drum. The toners are of different colors to make a multicolor image. The multicolor image is transferred to a receiving sheet which contacts the endless imaging web near the small diameter roller.

U.S. Pat. No. 5,043,761 to Johnson discloses a multicolor copier which includes a transfer roller for registering single color images. The copier includes an imaging drum and multiple toning stations. A series of electrostatic images are formed on the image drum and toned with different colors. The toners are transferred in registration to a portion of a continuous web receiving sheet by securing a portion of the web to a transfer roller in a first direction to receive an image and in a second direction to return the portion of the web to a position for receiving a second web image in registration. This does not provide for single pass multicolor printer and utilizes an intermediate imaging member and a transfer roller.

U.S. Pat. No. 4,773,270 to Nishikawa et al. discloses a multicolor copier which forms images of a plurality of colors in a superimposed manner on an identical unrolled portion of a recording web. The copier reciprocates an identical portion of the web a plurality of times to an image forming/processing station. This copier has low throughput due to the use of multiple passes to provide a multicolor image.

There are numerous problems associated with known color copiers. Multiple pass color copiers have reduced throughput and additionally require multiple iterations of advancing a transfer material, transferring an image portion corresponding to a particular primary color, and backing the transfer material to the starting location. This requires complex tracking, sensing and control to ensure quality image registration when the images are superimposed. Transient errors due to drives and roller components starting, stopping and accelerating are commonplace and hard to overcome without sophisticated, high- cost hardware to minimize or take account for these errors.

Single pass color copiers having only moderate throughput and usually have complex control and sensing requirements to ensure proper registration. This is due to the large number of interrelated components and many sources for registration and timing errors. This is primarily brought about due to positional errors between print engines, intermediate rollers and the image receiving sheet. Slippage may occur continually or intermittently between these interrelated components, causing registration errors. Additionally, multiple sensors and other hardware must control the relative velocities and accelerations of the components to ensure proper registration.

OBJECTS AND SUMMARY OF THE INVENTION

It is an object of the present invention to provides a high throughput, single pass direct transfer color printer with high precision image registration and image transfer.

It is another object of the present invention to provide a single pass direct transfer color printer utilizing a roll web based design which simplifies tandem engine architecture by eliminating a very difficult subsystem.

It is another object of the present invention to provide a high throughput, single pass direct transfer color printer which has improved registration resulting from isolation of multiple photoreceptors from additional components, such as fuser rolls.

It is yet another object of the present invention to achieve accurate image registration by direct control of paper web position and speed in a color printer using an overdriven vacuum belt paper transport having controlled slip between the belt and the paper.

It is another object of the present invention to achieve accurate image registration through the use of an arcuate paper path.

It is yet another object of the present invention to achieve better transfer efficiency by utilizing a direct corotron transfer, eliminating a mesh or intermediate belt of a color printer.

The present invention provides a high throughput, single pass direct transfer color printer using a roll web based design which simplifies tandem engine architecture by eliminating a very difficult subsystem. This eliminated subsystem could be the intermediate belt module or the paper escort subsystem.

Improved image registration is achieved by position/velocity synchronization of the paper web with respect to the photoreceptors. Frictional slip between the web and the overrunning vacuum transport develops web tension, which in turn provides a positive contact between the web and the photoreceptors needed for good image transfer. To isolate fuser motion disturbance, a web buckle between the vacuum transport and the fuser may be provided. A cutter furnishes a printout in an appropriate size.

A single pass direct transfer color printer according to the present invention is capable of providing high throughput, single pass color printing wherein a plurality of images are superimposed onto an image-receiving web and made into a final composite color image. The printer comprises a supply roll containing a length of image receiving web suitable for printing thereon located at an upstream portion of the printer, a register roller pair located near the upstream portion for supporting the web, a rotating driving member located at a downstream portion of the printer for moving the image-receiving web by rotation, and a plurality of image print engines disposed in tandem between the supply roll and the rotating drive member. The web travels along a paper path from the supply roll through the register roller pair where it then intimately contacts photoreceptor drums of the print engines, and past the rotating drive member at the downstream portion of the printer. Preferably, the paper path between the upstream and downstream portions is slightly convex. The convex paper path comprises a plurality of arcuate sections between the tandem engines. Two benefits are resulted from this configuration. The first is that the wrap formed by the paper web and the photoreceptor increases the transfer zone width and hence improves the transfer efficiency. The second is that the tension in the arcuate paper web will induce a normal force between the web and the photoreceptor. By adjusting the web tension, the proper amount of normal force can be obtained for high efficient toner transfer.

These and other objects will become apparent from a reading of the following detailed description in connection with the drawings.

BRIEF DESCRIPTION OF THE DRAWINGS

The invention will be described in detail with reference to the following drawing wherein.

DETAILED DESCRIPTION OF PREFERRED EMBODIMENTS

Figure 1:
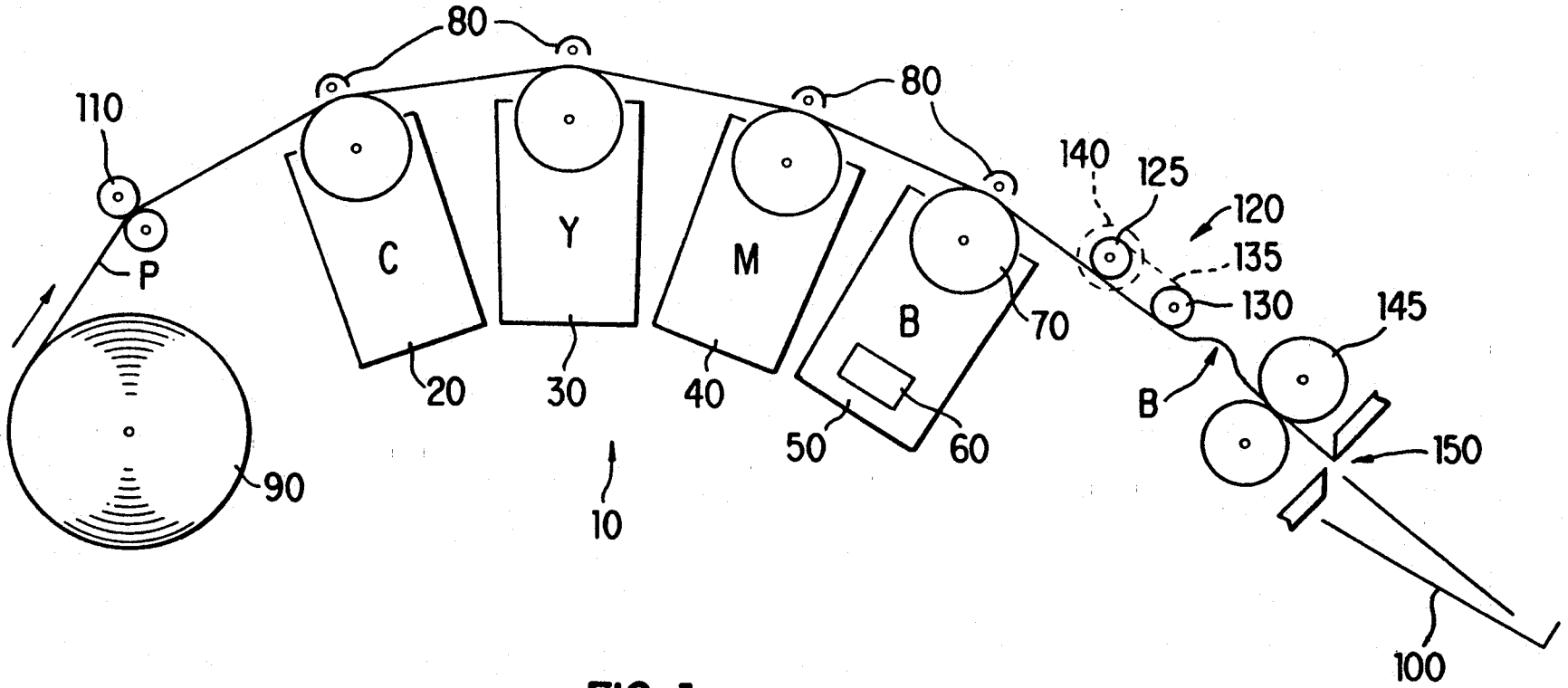
FIG. 1 shows a cross-sectional view of a tandem color printer according to the present invention.

FIG. 1 is a cross-sectional view showing an embodiment of the present invention. A tandem engine color printer apparatus 10 comprises three, or optionally four, sets of tandem electrophotographic print engines 20, 30, 40 and 50 which may be of any known xerographic type. Print engine 20 produces a cyan (C) image portion, print engine 30 produces a yellow (Y) image portion, print engine 40 produces a magenta (M) image portion, and optional print engine 50 produces a black (K) image portion. Preferably, the print engines are of the laser beam type which include a Raster Output Scanner 60, a photoreceptor drum 70 and a corotron 80.

A conventional transfer discharger, developing station and a cleaning station are also provided (not shown). A web of paper P is guided arcuately across the tandem print engines from a supply roll 90 to an output tray 100 by a paper guiding system. The paper guiding system includes a pair of support register rollers 110 which retain and guide the web P therebetween as the web P travels through the paper guiding system. The rollers 110 are located upstream from the tandem print engines 20, 30, 40 and 50. A vacuum transport 120 located downstream from the tandem print engines includes a drive roller 125 and an idler roller 130 which drive and support an endless belt 135 having a plurality of holes therein communicating with a source of vacuum for retaining the web P thereon as the endless belt 135 rotates. An edge guide 140 may be provided on one of the rollers 125, 130 or may be located immediately adjacent the belt to align and retain the lateral position of the passing web P. A fuser 145 is located downstream from the tandem print engines between the vacuum transport 120 and the output tray 100.

The initial start up operation is as follows: the web P is advanced through the support register rollers 110, fed between the corotrons 80 and the photoreceptor drums 70 of the tandem print engines 20, 30, 40, and optionally 50, fed past a lower side of the vacuum transport 120 and through fuser 145 which has a pair of fuser rollers.

In operation, a color image is recorded by a color input scanner, such as a Raster Input Scanner (RIS) (not shown) which records signals representing the image to be reproduced. These signals may be of any form or type known in the art. Optionally, these signals may be obtained directly from a computer without image scanning. A portion of these signals representing a cyan (C) component of the color image is sent to the cyan print engine 20, while a portion of these signals representing the other color components Y, M and K are sent to respective print engines which use these signals to produce a latent image on respective photoreceptor drums 70 corresponding to the respective color.

The web P is conveyed and drawn toward the fusing device 145 successively through portions of the tandem print engines 20, 30, 40 and 50 by movement of the vacuum transport 120 which is controlled by appropriate drive means. Preferably, the vacuum transport is overdriven in the range of 1 to 5% causing some slip between the belt and the web and providing a tension force on the web. While the web is successively advancing across the print engines, an image portion related to the cyan component of the image to be reproduced is formed on an outer surface of the photoreceptor drum 70, followed by successive forming of yellow, magenta and optionally black image portions onto respective photoreceptor drums 70. These image portions are transferred onto a surface of the advancing web P in a superposed relationship by transfer dischargers to form a composite color image on the web P in a single pass of the web across the tandem print engines 20, 30, 40 and 50. The timing of transfer of the superimposed image portions is controlled by synchronization of the web and photoreceptors velocities derived from encoders mounted on registration roll 110 and photoreceptors 20, 30, 40, and 50.

The present invention relies on a friction force being applied by the belt 135 to confine the travelling web P to the outer surface of the photoreceptor drums 70 of all of the print engines so that there is no slack anywhere in the arcuate paper web. This is accomplished by controlling the vacuum applied to the travelling web.

Figure 2B:
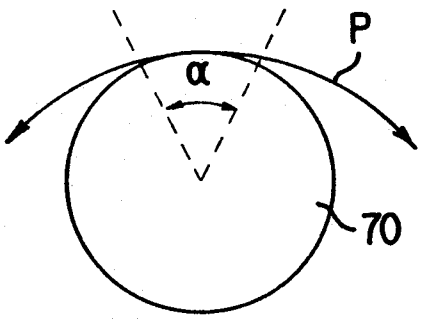
FIGS. 2A and 2B show surface contact between a web and a drum of the present invention at different arcuate paper path angles.
Figure 2A:
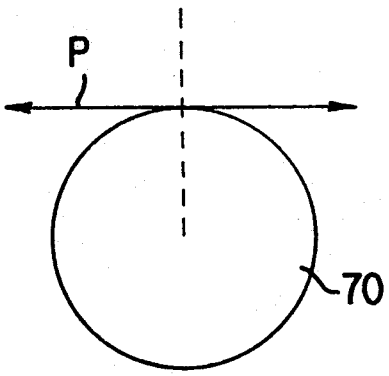

The arcuate path between the upstream and downstream portions of the color printer 10 applies a normal force to the drums 70 of the print engines which enhances image transfer by increasing contact pressure between the web P and the drums 70. Additionally, the arcuate paper path increases surface contact of web P with drums 70. The amount of web P which contacts an outer surface of drums 70 at any given time is increased from a negligible tangential intersecting point (FIG. 2A) when an arcuate angle is 0°, i.e., a straight path, to an arcuate section (having an angle a) of the outer circumference of drum 70 dependent on the degree of curvature in the arcuate paper path (FIG. 2B).

Preferably, as shown in FIG. 1, the plurality of print engines 20, 30, 40 and 50 form a radius of curvature substantially equal to the radius of curvature of the arcuate paper path. This applies equal tension and normal forces to each drum 70 resulting in high quality, consistent image transfers between all of the drums 70.

In a preferred embodiment, the web P is provided with a buckle B located between vacuum transport 120 and fuser 145. The buckle B can be provided by controlling the relative velocities of the registration roll 110 and the fuser 145 upon initialization such that a buckle is formed. Upon continued operation, the buckle B remains which isolates the direct transfer printer engines from external forces which may affect ultimate registration or color quality. In particular, this isolates the tandem print engines and sections of web P located thereon from any disturbances caused by the fuser 145, such as fuser vibration, or other downstream components.

The color printer according to the present invention obtains a high productivity which may only be limited by the ability of the fuser 145 to fuse the transferred color images on web P at high speeds.

The present invention, due to its web roll, is capable of custom output size by using both a cutter (cross direction) and a slitter (process direction). This is accomplished by a cutter assembly 150 provided downstream from the fuser 145, between the fuser 145 and the output tray 100. The cutter assembly 150 may include just a cross-direction pair of blades which cut the web P into discrete sheets of a predetermined size, or may further include process direction blades which slit the web P in a process direction. This allows custom output sizes to be created.

Since the present invention directly transfers the color image onto the web P without the use of a mesh or an intermediate belt, the present invention achieves better transfer efficiency. Additionally, control and associated registration of the superimposed images is simplified and the accuracy of the registration is substantially increased.

This not only reduces the registration of the superimposed images, but also reduces the working number of components in the color printer which reduces printer cost, maintenance and control.

The invention has been described with reference to the preferred embodiments thereof, which are illustrative and not limiting. Various changes may be made without departing from the spirit and scope of the invention as defined in the appended claims.

What is claimed is:

1. A direct transfer color printer in which a plurality of images are superimposed onto an image receiving web and made into a final composite color image in a single pass, the printer comprising:

a supply roll containing a length of image receiving web suitable for printing thereon located at an upstream portion of said printer;

a register roller pair located near the upstream portion for supporting said web;

a driving means located at a downstream portion of said printer for imparting tension to said image receiving web to remove said image receiving web from said supply roll; and a plurality of image print engines disposed in tandem along a predetermined convex radius of curvature between said register roll pair and said drive means, wherein said web travels in an arcuate paper path, along said radius of curvature, from said register roller pair to said driving means, intimately contacting a portion of each of said print engines, said driving means imparting tension in said image receiving web to apply a force normal to said print engines to said web solely by the combination of said register roller pair, said driving means and said arcuate paper path to increase contact pressure and surface contact between said web and said print engines allowing direct transfer color printing without an intermediate transfer belt for pressing the web into contact with the portion of each print engine.

2. The direct transfer color printer of claim 1, wherein said plurality of image print engines consists of three engines, each for printing one of the group of colors comprising cyan, magenta and yellow.

3. The direct transfer color printer of claim 1, wherein said plurality of image print engines consists of four engines, each for printing one of the group of colors comprising cyan, magenta, yellow and black.

4. The direct transfer color printer of claim 1, further including a fuser located downstream from said rotating drive means for fusing the superimposed color image.

5. The direct transfer color printer of claim 1, wherein said rotating drive means is a vacuum transport including an endless belt supported by a pair of rollers, one of said pair of rollers being driven by a motor.

6. The direct transfer color printer of claim 5, wherein said vacuum transport is overdriven causing controlled slip between said belt and said web to apply a tension force on said web.

7. The direct transfer color printer of claim 1, wherein said rotating drive means is a second register roller pair, one of said pair being driven by a motor.

8. The direct transfer color printer of claim 1, further including a cutter assembly for cutting of said web into discrete sheets.

9. The direct transfer color printer of claim 8, wherein said cutter assembly comprises a cutter which cuts said web into discrete sheets in a direction transverse to the paper path.

10. The direct transfer color printer of claim 9, wherein said cutter assembly further comprises a cutter which slits said web into discrete sheets in a direction parallel to the paper path.

11. A direct transfer color printer in which a plurality of images are superimposed onto an image receiving web and made into a final composite color image in a single pass, the printer comprising:

a supply roll containing a length of image receiving web suitable for printing thereon located at an upstream portion of said printer;

a register roller pair located near the upstream portion of said printer for supporting said web;

a driving means located at a downstream portion of said printer for moving said image receiving web;

a fuser located at the downstream portion of said printer after said rotating driving means; and a plurality of image print engines disposed in tandem between said supply roll and said rotating drive means, each for supplying a portion of the final composite color to said web, wherein said web travels along an arcuate paper path from said upstream portion to said downstream portion, said supply roll travelling through said register roller pair, intimately contacting a portion of said print engines, and past said rotating drive means at the downstream portion of the printer, said web including a buckle between said rotating driving means and said fuser.

12. The direct transfer color printer according to claim 11, wherein the paper path has a convex arcuate portion extending from said register roller pair to said rotating drive means.

13. The direct transfer color printer according to claim 12, wherein said plurality of print engines are located on a radius of curvature substantially equal to said arcuate portion.

14. The direct transfer color printer according to claim 11, wherein said drive means is overdriven providing limited slip between said drive means and said web and applying a tension force to said web.

15. A direct transfer color printer in which a plurality of images are superimposed onto an image receiving web and made into a final composite color image in a single path, the printer comprising:

a supply roll containing a length of image receiving web suitable for printing thereon, located at an upstream portion of said printer;

a register roller located near the upstream portion for supporting said web;

a drive means located at a downstream portion of said printer for moving said image receiving web, said drive means being overdriven causing controlled slip between said drive means and said web to apply a tension force on said web; and a plurality of image print engines in tandem along a predetermined convex radius of curvature between said register roller and said drive means, wherein said web travels along an arcuate path corresponding to said radius of curvature, intimately contacting a portion of each of said print engines.

* * * * *